United States Patent [19]

Dieringer et al.

[11] Patent Number: 4,776,122

[45] Date of Patent: Oct. 11, 1988

[54] MAGAZINE FOR AUTOMATIC WEAPONS AND THE LIKE

[76] Inventors: Dale E. Dieringer, 7720 Teller St., Arvada, Colo. 80003; Emil Vyprachticky, 7713 Webster Way, Arvada, Colo. 80004

[21] Appl. No.: 72,636

[22] Filed: Jul. 13, 1987

[51] Int. Cl.[4] ..... F41C 25/02

[52] U.S. Cl. ..... 42/50

[58] Field of Search ..... 42/50, 7, 18, 22

[56] References Cited

U.S. PATENT DOCUMENTS

| | | | |
|---|---|---|---|
| 2,777,235 | 1/1957 | Hopkins | 42/50 |
| 3,087,270 | 4/1963 | Stoner | 42/50 |
| 3,577,860 | 5/1968 | Jestrabek | 42/50 |
| 4,127,954 | 12/1978 | Hausmann | 42/50 |
| 4,366,638 | 1/1983 | Ketterer et al. | 42/50 |
| 4,509,283 | 4/1985 | Chesnut | 42/50 |
| 4,580,364 | 4/1986 | Vyprachticky | 42/50 |

FOREIGN PATENT DOCUMENTS

| | | | |
|---|---|---|---|
| 635534 | 11/1963 | Belgium | 42/50 |
| 406904 | 8/1966 | Switzerland | 42/50 |

*Primary Examiner*—Charles T. Jordan
*Attorney, Agent, or Firm*—Edwin L. Spangler, Jr.

[57] ABSTRACT

This invention relates to a curved or angled multiple-round rifle cartridge magazine of the type designed for use with ammunition having tapered shell casings necked-down at their small end to accommodate a relatively smaller bullet characterized by a pair of negator springs attached for pivotal movement in spaced substantially parallel relation one behind the other to a sidewall of the shell chamber and a follower having front and rear side-opening spring-coil-receiving pockets for the coiled portions of the springs that permit the coils seated therein to tilt as the follower moves up through the chamber and the uncoiled portions of the springs change their angular relation to the latter and to the shell stack, both of the springs having medial portions lying between their coiled ends and the points of attachment to the magazine sidewall that curl inwardly toward the shell stack with the front spring of the pair being so located relative to the stack that its leading edge lies forwardly of the annular shoulder at the beginning of the necked-down portion of the shell casings at all times in which the follower is coming up from the bottom of the shell chamber and traversing the curve or bend. The coil-receiving pockets in the follower are specially shaped to accommodate the tiltable movement of the coils therein. Moreover, a rib is provided in the wall of the shell chamber to which the spring ends are attached in position such that it engages and holds the leading edge of the front spring into the space ahead of the annular shoulders while, at the same time, twisting the medial portion of the latter so as to lift its trailing edge out of substantial frictional contact with the tapered bodies of the shell casings.

9 Claims, 2 Drawing Sheets

MAGAZINE FOR AUTOMATIC WEAPONS AND THE LIKE

BACKGROUND OF THE INVENTION

The 0.223 caliber cartridge is the accepted standard for use in military weapons in nearly, if not all, the major countries of the world. While the weapons themselves may differ from one country to another, the cartridges do not. On the other hand, all of the North Atlantic Treaty Organization (NATO) countries use even the same weapon.

The cartridge case carrying the 0.223 caliber bullet is much larger and it also tapers from a diameter of approximately 0.375 inch at its rear end where the extractor groove and rim is located on down to about 0.350 inch at the point where it is "necked down" to the size of the bullet thus leaving an annular shoulder. The taper of the shell casings is such that they will not stack vertically as some cartridges will that have more or less cylindrical casings with no rim on the rear end of larger diameter. Accordingly, in order for these tapered shell casings to stack atop one another, the magazine holding them must either be curved or have an angled bend adjoining a pair of straight sections positioned both above and below the latter. It makes little difference whether the stack is a single shell wide, is staggered or perhaps even made up of two rows side-by-side, the magazine must be either curved or bent at a point intermediate its ends to accommodate the tapered shell casings.

Of course, the standard version of the magazine used by the U.S. military in its M16A2 automatic rifle is configured to accommodate the aforementioned tapered shell casings and, presumably, any magazine developed for use in this or any other similar weapon will have to be similarly shaped along with being designed to fit into the firing chamber. Unfortunately, the ones in current use have a rectangularly-coiled helical spring in the bottom to lift the follower which limits the capacity of the unit and, most significant of all, makes them prone to jam. The jamming problem is so acute that the instructors teaching the use of the weapon oftentimes advise the soldiers to load no more than eighteen shells in a twenty shell clip or twenty-five shells in a thirty shell one. Of course, the more shells a clip will hold and feed effectively, the greater the fire-power and effectiveness of the weapon.

The problem with the present clips no doubt stems, in part at least, from the use of the helical spring to lift the follower and shell stack since as it expands it loses much of its biasing force even though the load of the shells in the stack thereabove becomes successively lighter. Also, springs of this type when tightly compressed oftentimes exceed their load limit and thus lose their ability to lift the shell stack and push the shells into the chamber. Whatever the reason, the clips presently in use are unsatisfactory.

FIELD OF THE INVENTION

The present invention relates generally to multiple cartridge magazines of the type employing negator springs to raise the follower and, more particularly, to that specific magazine designed to carry 0.223 caliber ammunition for use in automatic weapons used by the military.

DESCRIPTION OF THE RELATED ART

The closest prior art known to applicant is contained in U.S. Pat. No. 4,580,364 issued to one Emil Vyprachticky in which applicant is a part owner. This patent discloses a plastic rifle cartridge magazine employing negator springs attached to the sidewall to raise the follower. The Chesnut U.S. Pat. No. 4,509,283 also uses a negator spring to pull the follower; however, it is attached to an endwall, not one of the sidewalls. In addition to the Chesnut patent, of record in the Vyprachticky patent referred to above are several other U.S. and foreign patents that employ negator springs in some fashion, specifically Hopkins U.S. Pat. No. 2,777,235; Rowe Jr. U.S. Pat. No. 3,399,480; Jestrabek U.S. Pat. No. 3,577,860; Hausmann U.S. Pat. No. 4,127,954; Ketterer et al U.S. Pat. No. 4,366,638; Steim's Belgian Patent No. 635,534; and, the Swiss patent to Sion No. 406,904.

None of these prior art patents even recognizes, yet alone solves, the problem inherent in this type of spring, namely, the curvature present in the uncoiled length thereof that causes its sharp edges to dig into the shell casings resulting in them not feeding properly.

SUMMARY OF THE INVENTION

In applicant's copending application Ser. No. 052,232, filed May 20, 1987, he discloses a solution to the spring curling problem for in-the-handle magazines like, for example, those used in 0.45 caliber pistols. These cartridges, however, have cylindrical shell cases and the extractor rims on their rear ends do not project beyond the casings themselves. What this means, of course, is that the shells stack vertically in a straight line and the magazine is straight also.

When applicant attempted to adapt the same solution to the curved military clip, it didn't work. The primary reason, of course, was the fact that there was no way in which the negator springs could be made to bend around the corner or curve in the plane of their uncoiled lengths thus following the curve of the stack such that the rearmost edge of a spring seated in the extractor groove while the foremost edge curled around the nose of the bullet.

Applicant discovered quite unexpectedly, however, that at least in the military clip housing a stack of tapered shells having an annular shoulder where the casing is necked down to receive the bullet, it was not necessary to have the rear edge of the rear spring of a pair seated in any of the extractor grooves of the stack nor did the front edge of the forwardmost spring of the pair have to curl around the annular shoulder at the junction between the casing and the bullet of each shell in the stack provided that it was so positioned that it did so with respect to those shells located in and adjacent to the bend or curve in the cartridge case. More specifically, applicant discovered that the curl in the springs was far more pronounced in the middle of the uncoiled length than at either end thereof where it just came off the coil or its free end was secured to the wall of the casing. If, therefore, the area of greatest curl was controlled such that it was allowed to twist and seat in or ahead of the annular shoulder of those shells on or near the curve, the problem was solved. Also, the springs of necessity begin to move farther back on the shell casings as the stack is depleted, therefore, enough room must be left for the front spring to still twist and curl around the shoulder of the shells on the curve as the springs reach their rearmost positions.

Applicant also discovered that oversize pockets in the follower were required for the coils seated therein to tilt as the springs went one way and the follower another. In addition, best results were obtained when the pockets were provided with fulcrum-forming projections shaped and adapted to maintain essentially point contact with the coil as it rolls up and tilts.

It is, therefore, the principal object of the present invention to provide a novel and improved multiple cartridge magazine especially adapted for use in the automatic weapons used by the military.

A second objective is that of providing a clip of the type aforementioned having a greater shell-carrying capacity than comparable magazines using helical or other type springs coiled underneath the follower as opposed to being located alongside the shell stack.

Another object of the invention herein disclosed and claimed is to provide a magazine, the shell-carrying capacity of which can be increased by one-third and still remain reliable and substantially jam-free.

Still another objective is to provide a forty-five round capacity stainless steel clip to replace the thirty round standard aluminum ones, some nine steel clips or thereabouts weighing approximately the same as twelve aluminum ones but containing at least forty-five more rounds assuming capacity loading.

An additional object is to provide a cartridge-feeding magazine where jamming is prevented by taking advantage of the space provided at the necked down end of certain tapered shells which allows the portions of greatest curl intermediate the coiled end and the secured end of a negator spring to twist and enter this space as the springs traverse those shells located in the bend of the cartridge compartment.

Further objects are to provide a device of the class described which is rugged, versatile, easy to load and unload, readily adaptable for use in a wide variety of weapons of the type using external magazines, and one that can be loaded ten shells at a time using a conventional stripper clip.

Other objects will be in part apparent and in part pointed out specifically hereinafter in connection with the description of the drawings that follows.

DESCRIPTION OF THE PREFERRED EMBODIMENTS

Figure 1:
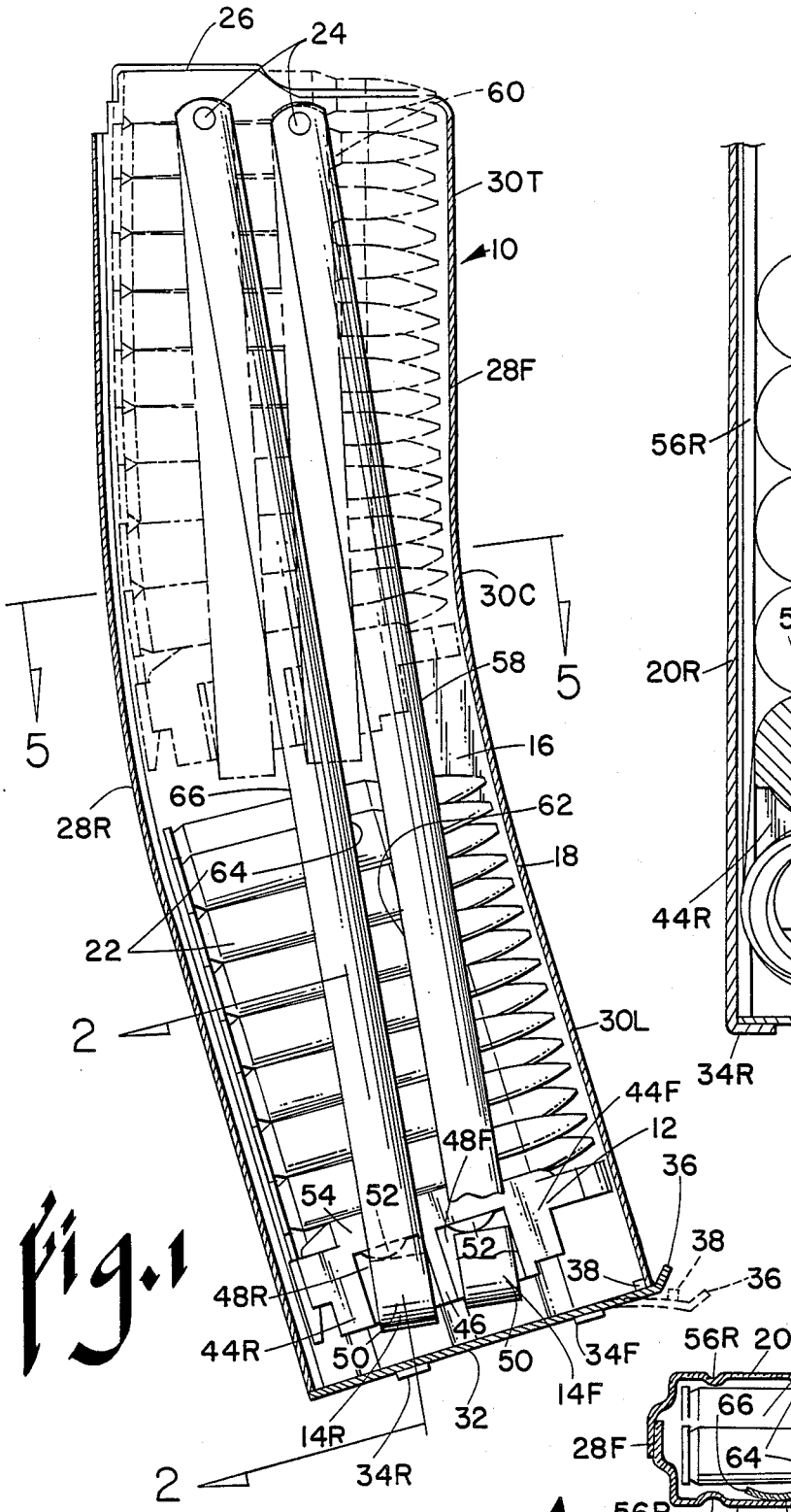
FIG. 1 is a right side elevation with the sidewall removed and other parts broken away and shown in section to better reveal the interior construction.

Referring next to the drawings for a detailed description of the present invention, reference numeral 10 has been chosen to broadly designate the improved rifle magazine or clip of the present invention which will be seen to include a follower 12 pulled by a pair of constant force negator springs 14R and 14F through a curved or angled cartridge compartment 16 contained within a hollow housing 18. The housing is comprised of right and left sidewalls 20R and 20L, respectively, which are spaced apart and adapted to confine a staggered stack of shells 22. One free end of each of the springs 14F and 14R are riveted or otherwise secured to one of the sidewalls (the right one as shown) as indicated by reference numeral 24. The top of the magazine is left open except for an opposed pair of overhanging flanges 26 which serve to hold the shells in the shell compartment until such time as they are pushed one at a time out into the breech of the weapon W by the bolt (not shown). These flanges are conventional, but nonetheless important, in that they accommodate the stripper clips by means of which shells are loaded ten at a time. Front and rear endwalls 28F and 28R bridge the space between the sidewalls and close in the shell compartment 16 except for the top and bottom.

In the particular form illustrated, the magazine is shown shaped to provide an upper straight section 30T, a lower straight section 30L and a curved section 30C between the two. Alternatively, tapered shells like those shown can be successfully stacked in a continuously-curved compartment 16 provided, of course, that the upper section 30T will fit into the chamber C of the weapon W. The clip illustrated is designed for use in the U.S. military's automatic rifle known as the M16A2 and it requires that at least the upper section be straight; however, there are other weapons of similar design, the chamber of which will accommodate curved upper sections.

Figure 2:
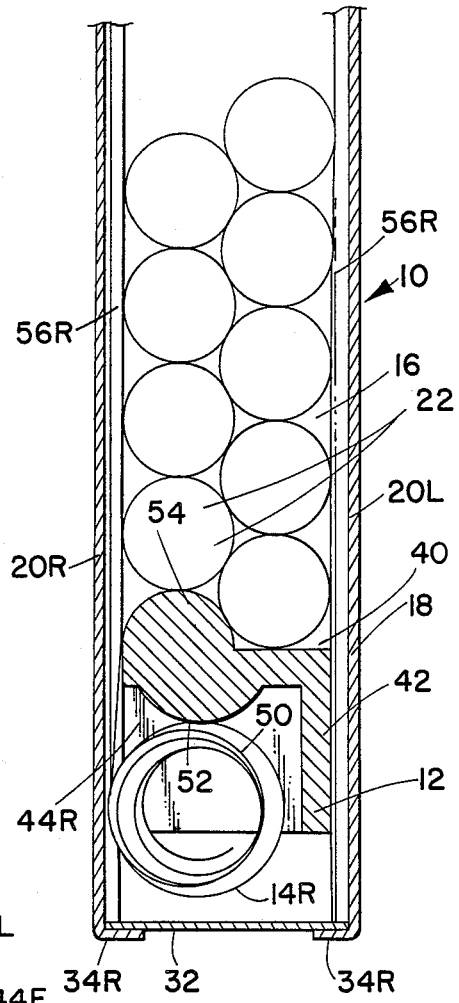
FIG. 2 is a fragmentary section to a greatly enlarged scale taken along line 2—2 of FIG. 1.

The open lower end of the magazine is covered by a removable cleanout door 32 which is retained in place by front and rear pairs of inturned tabs 34F and 34R, respectively that are formed integral with the sidewalls as can be most clearly seen in FIG. 2. Door 32 is fabricated from spring metal and is provided with an upturned end 36 which projects slightly beyond the front endwall 28F in position to be grasped and sprung downwardly into the phantom-line position in which the door is shown in FIG. 2 thus freeing upset rib 38 that locks behind the endwall inside the shell compartment when the door is fully closed as shown in full lines. Since the springs 14 operate independently of door 32, the latter is easily removed to clean out the interior of the shell compartment thus further insuring that the shells will not hang up and continue to feed properly.

The magazines for the U.S. M162A 0.223 caliber automatic rifle are made of aluminum and space considerations are such that it cannot accommodate springs 14 extending up alongside the shell stack, at least insofar as that portion 30T of the magazine at the upper end thereof that must fit up inside shell chamber C of the weapon W. Of course, those portions of the magazine external to the rifle can have walls of any thickness and still leave room for the springs. Applicant has found that by fabricating the magazine from stainless steel of a gage substantially thinner than the aluminum stock from which they are presently being made, enough space can be gained between the sidewalls to accommodate both the shell stack and the springs without, at the same time, increasing the overall thickness of the unit. Gaining this additional space for the springs, however, does not in any way solve the jamming problem because unless the springs 14, and most especially front spring 14F, are properly located relative to the shells in the bend 30C, they still are subject to jamming.

Follower 12 is most clearly seen in FIGS. 1 and 2 to which detailed reference will now be made. It has a top wall 40, a left sidewall 42, front and rear endwalls 44F and 44R, respectively, and a partition wall 46 between the endwalls that cooperate to define a pair of pockets 48R and 48F that open downwardly and toward the right sidewall 20R. The coiled portions 50 of the springs 14 are retained in the pockets 48 as shown. It is significant to note, however, that the space within the pockets between the partition wall 46 and the adjacent endwall is somewhat wider than the width of the coil (see FIG. 1) so as to accommodate the tilt of the follower relative to these coils as the follower traverses the bend 30C. In other words, while springs 14 move slightly from the full-line forward position shown in FIG. 1 to the phantom-line rear position as the follower moves up in the shell compartment 16, they only swing through an angle of a few degrees, whereas, the follower moving from its full-line to phantom-line position tilts through a considerably larger angle and the wider pockets are required to accommodate these differences. Moreover, the axis of the coil 50 tilts through different angles relative to the top wall 40 over the compartments and to accommodate this tilt without causing the springs to hang up, applicant has found it desirable to provide the underside of the top wall in each pocket with a fulcrum 52 shaped and adapted to maintain point contact with the coils, the particular one shown being essentially hemispherical. Atop top wall 40 of the follower is provided an elongate half round hump 54 which supports the lowermost two shells in the stack in side-by-side staggered columnar relation as seen in FIG. 2. This feature forms no part of the present invention and is found on the followers of the prior art magazines.

Figures 3, 4:
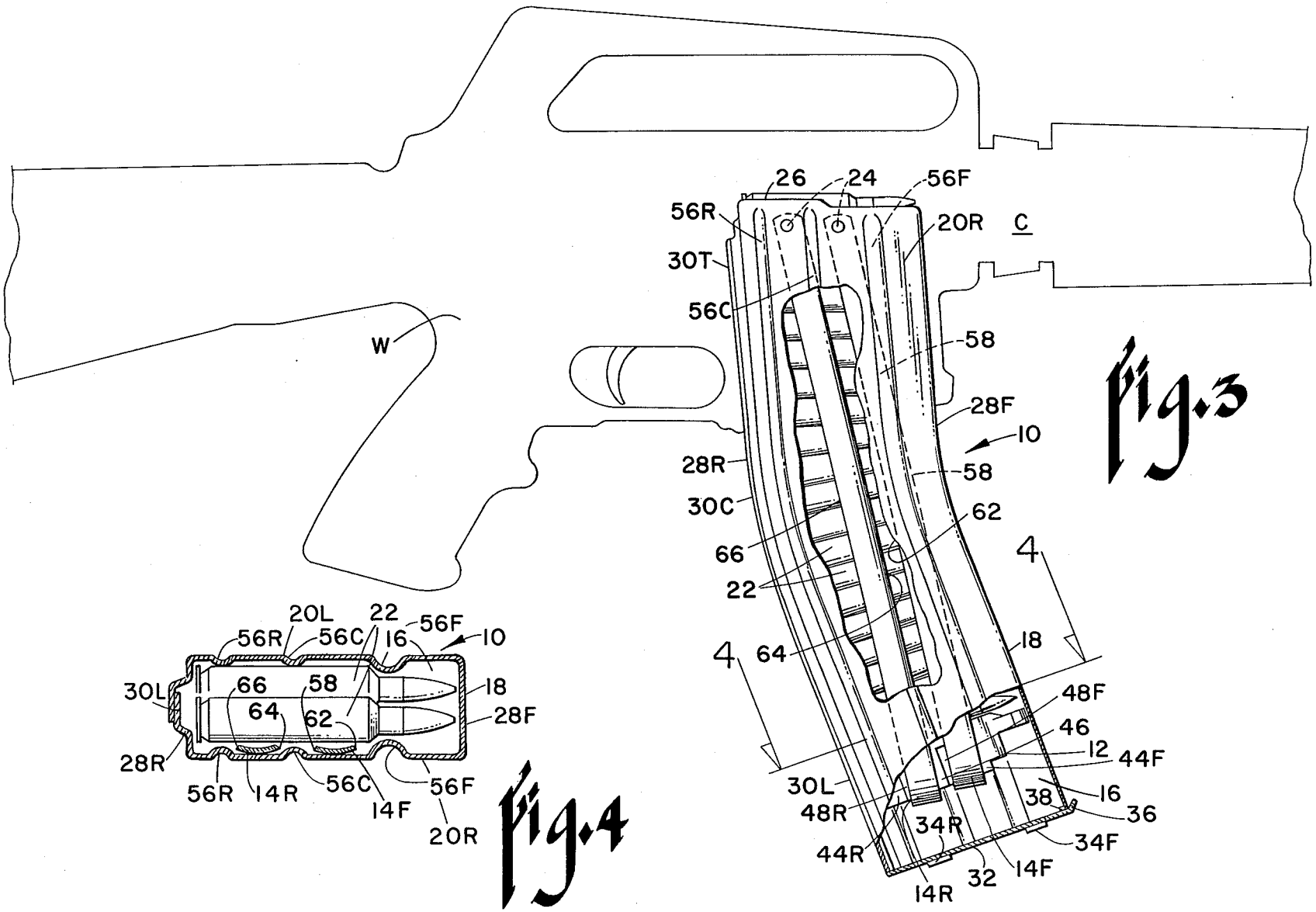
FIG. 3 is a right side elevation to a greatly reduced scale showing the magazine mounted in the chamber of an automatic rifle, portions of the clip having been broken away to expose the interior.
FIG. 4 is a section, again enlarged, taken along line 4—4 of FIG. 3; and, FIG. 5 is a section to the same scale as FIG. 4 taken along line 5—5 of FIG. 1.

Both sidewalls of the magazine are internally ribbed as shown. The rearmost pair of ribs 56R and the center pair 56C cooperate to provide rails supporting the stack of shells as they ride up through the shell compartment ahead of the follower. These ribs together with the front pair 56F which are somewhat deeper, are all found on existing magazines, however, the functions performed by the front one on the righthand sidewall is materially increased in that it engages the front edge 58 of front spring 14F and hold the portion thereof in and adjacent the curve 30C twisted around the shoulders 60 of the shells stacked thereagainst thus lifting the inside edge 62 free of the shell casings as shown most clearly in FIG. 2. The simple, yet unobvious, expedient of twisting the medial portion of the front spring 14F around the shoulders 60 of the shells adjacent sidewall 20R and holding it there with rib 56F was found sufficient to relieve the drag caused by the rear edge 62 of this spring on the shell casings thus effectively eliminating the jamming problem. As previously mentioned, those portions of the front spring adjacent the coil and the fastener 24 have somewhat less curl as seen in FIG. 4, therefore, being flatter, their edges at this point provide a good deal less frictional contact than these same edges would in the medial part of the uncoiled length if allowed to rub against the shell casings. The net result is that even though the end portions of spring 14F that lie closely adjacent the fastener 24 at its upper end and the corresponding portion adjacent the coil when fully uncoiled do not twist and wrap around shoulder 60 of the shells in this region or otherwise seat in the area of reduced diameter at the front end thereof where the bullet is located, nevertheless, such contact as there is becomes so minimal as to preclude jamming. Thus by precisely locating the leading or front edge 58 of spring 14F relative to the shells in the medial portion of the magazine relative to the shoulder 60 of the shells in this area such that the spring can twist around the latter and free or at least lessen the contact of the rear edge 62 with the shell casings, the problem is solved especially when the relatively less curled portions of the spring adjacent the coiled part and the point of attachment 24 which may, in fact, not curl around the shell casing shoulder in the manner of the medial portion, nevertheless, contact the tapered wall of the casing rather lightly.

Figure 5:
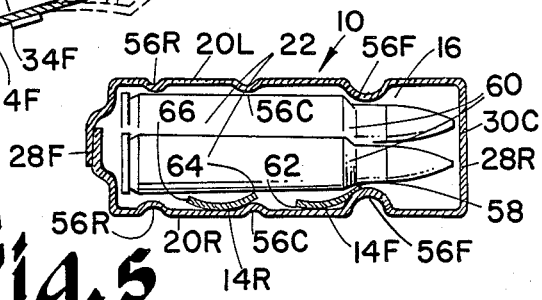

The location of the rear spring 14R is less critical and its function is largely one of cooperating with the front spring to insure that the follower tracks properly without becoming skewed. In other words, with spring 14F being located well up toward the bulet ends of the shells in the stack, its pull will tend to tilt the follower so that it does not track the shell compartment properly. The addition of a second spring 14R nearer the rear end of the shells in the stack solves this problem and they act together to keep the follower on track. It is worthy of note, however, in connection with FIG. 5 that even the rear spring 14R in the medial regions of the magazine illustrated therein is slightly twisted and its leading edge 64 is held by the middle rib 56C so as to make approximately the same frictional contact with the relatively smaller surface of the tapered shell casing wall at this point as the rear edge 66 makes with the latter farther to the rear. Obviously, due to the fact that the shell casing behind the shoulder 60 is tapered, rear edge 66 would rub harder against the latter than front edge 64 if they both lay the same distance from the adjacent sidewall. On the other hand, if the spring were twisted ever so slightly so that the front edge was farther from the sidewall than the rear edge, such contact as is made would be more nearly equal.

While the magazine of the present invention has been illustrated and described in connection with a military version fabricated from metal, preferably stainless steel, it is by no means so limited and for other applications it could be made from plastic materials, aluminum or alloys of the latter metal. By the same token, the capacity of the magazine is not even limited to forty-five rounds since its capacity depends primarily on the taper of the shells and the extent to which the magazine must be bent or curved to accommodate them and still permit the leading edge of the front negator spring to twist and curl around the shoulders of most of the shells in the medial section of the clip. Also, the magazine is not at all limited to shells stacked in staggered relation as shown, but rather, it is equally applicable to a single vertical row of shells or two rows in side-by-side relation.

What is claimed is:

1. In a multiple-round cartridge magazine including spaced sidewalls and endwalls cooperating to define an open-topped chamber bent or curved to retain in stacked relation a plurality of cartridges of the type having tapered casings further necked-down to form an annular shoulder at their small ends adapted to receive and hold a relatively smaller bullet, a follower having at least one side-opening spring-coil-receiving pocket, said follower being positioned within the chamber underneath the stack for movement therethrough to push the cartridges thereabove one-at-a-time out through the open top, and at least one negator spring having an upper end attached to one of the sidewalls of the chamber alongside the stack near the top thereof and its other end coiled within one of the side-opening pockets in the follower, and wherein the aforementioned spring or springs upon extension of the follower produce an uncoiled portion located alongside the stack which has a transversely-curved medial portion between its relatively flatter point of attachment and coiled portion, said medial portion being so shaped that the front and rear edges thereof define a concavity opening toward the stack, the improvement which comprises: providing the follower with front and rear side-opening spring-coil-receiving pockets arranged one behind the other and pivotally attaching a front negator spring and a rear negator spring to the same sidewall toward which the spring-coil-receiving pockets in the follower open for coordinated movement in front to rear substantially parallel relation from a more angled to a less angled position as the follower retracts and moves around the curve or bend in the chamber, the front spring of the pair being so positioned relative to the shell stack such that the front edge of its medial portion lies forwardly of the annular groove defined by the necked-down portion of the shell casing and is free to twist and curl around the latter at all times during which the follower is traversing the lower end of the chamber and rounding the curve or bend therein.

2. The improvement as set forth in claim 1 wherein: the side-opening coil-receiving-pockets in the follower are oversized widthwise to accommodate the relative tiltable movement of the coiled portions of the springs housed therein as the uncoiled portions pivot and assume different angular relationships to the follower during its upward excursion through the chamber.

3. The improvement as set forth in claim 1 wherein: the spring-coil-receiving pockets in the follower include downwardly-facing wall-forming means adapted to engage and retain the coiled portions of the springs as they uncoil, said wall-forming means being shaped to define fulcrums upon which said coiled portions tilt as their uncoiled portions assume different angular relationships to the follower during its upward excursion through the chamber.

4. The improvement as set forth in claim 1 wherein: an inwardly-projecting rib is provided in the sidewall to which the springs are attached, said rib being positioned and adapted to engage a forward portion of the front spring and twist the latter such that its front edge is forced and held into the necked-down area forwardly of the annular shoulder while simultaneously lifting the rear edge thereof so as to lessen its frictional contact with the shell casings.

5. The improvement as set forth in claim 1 wherein: the chamber is open at the bottom, the sidewalls include inturned ear-forming means, and a removable door is slidably mounted on said ear-forming means.

6. The improvement as set forth in claim 1 wherein: the side-opening spring-coil-receiving pockets are separated by a partition wall effective to maintain a fixed spaced substantially parallel relation between the uncoiled portions of the springs.

7. The improvement as set forth in claim 1 wherein: the side-opening spring-coil-receiving pockets include wall-forming means on the wall opposite the open sides thereof, said means defining a barrier to keep the uncoiling coils out of frictional contact with the adjacent sidewall.

8. The improvement as set forth in claim 2 wherein: the follower includes spaced endwalls and a partition wall intermediate the endwalls cooperating therewith to define the oversize pockets.

9. The improvement as set forth in claim 3 wherein: the fulcrums are substaintially hemispherical and make point contact with the outermost spring coil.

* * * * *